US010648773B2

(12) United States Patent
Owens et al.

(10) Patent No.: US 10,648,773 B2
(45) Date of Patent: May 12, 2020

(54) KIT AND METHOD FOR ALIGNING A SCOPE ON A SHOOTING WEAPON

(71) Applicants: Russell Scott Owens, Williston, SC (US); John Wardlaw, Winnsboro, SC (US)

(72) Inventors: Russell Scott Owens, Williston, SC (US); John Wardlaw, Winnsboro, SC (US)

( * ) Notice: Subject to any disclaimer, the term of this patent is extended or adjusted under 35 U.S.C. 154(b) by 0 days.

(21) Appl. No.: 16/369,575

(22) Filed: Mar. 29, 2019

(65) Prior Publication Data

US 2019/0301836 A1 Oct. 3, 2019

Related U.S. Application Data

(60) Provisional application No. 62/649,656, filed on Mar. 29, 2018.

(51) Int. Cl.
*F41G 1/54* (2006.01)
*F41G 1/38* (2006.01)

(52) U.S. Cl.
CPC ..... *F41G 1/545* (2013.01); *F41G 1/38* (2013.01)

(58) Field of Classification Search
CPC ... F41G 1/38; F41G 1/387; F41G 1/54; F41G 1/545; F41G 3/323; F41G 3/32
See application file for complete search history.

(56) References Cited

U.S. PATENT DOCUMENTS

| | | | | |
|---|---|---|---|---|
| 4,676,636 | A * | 6/1987 | Bridges | F41G 3/323 33/286 |
| 5,442,860 | A | 8/1995 | Palmer | |
| 5,499,455 | A * | 3/1996 | Palmer | F41G 1/545 33/DIG. 21 |
| 5,878,504 | A * | 3/1999 | Harms | F41G 1/545 33/286 |
| 6,371,004 | B1 * | 4/2002 | Peterson | F41G 1/545 356/153 |
| 6,813,855 | B2 | 11/2004 | Pinkley | |
| 6,862,833 | B1 | 3/2005 | Gurtner | |
| 7,162,825 | B2 | 1/2007 | Ugolini et al. | |
| 8,561,341 | B1 * | 10/2013 | Dihlmann | F41G 1/545 42/120 |
| 8,745,914 | B2 | 6/2014 | Schmidt | |
| 8,800,154 | B2 | 8/2014 | Schmidt | |
| 9,025,040 | B2 | 5/2015 | Thyssen et al. | |
| 9,115,957 | B1 * | 8/2015 | Winker | F41G 3/323 |
| 9,182,211 | B2 * | 11/2015 | Jones | G01B 5/25 |
| 9,377,273 | B1 * | 6/2016 | Loper | F41G 1/545 |

(Continued)

OTHER PUBLICATIONS

Digital Angle Detector, User's Manual, General Tools and Instruments, dated Dec. 9, 2014.

(Continued)

*Primary Examiner* — Benjamin P Lee
(74) *Attorney, Agent, or Firm* — JK Intellectual Property Law, PA

(57) ABSTRACT

A kit and method for aligning a scope located a shooting weapon including calibrating first and second electronic alignment sensors while on the shooting weapon, placing the second electronic alignment sensor on the scope, and adjusting an alignment of the scope relative to the shooting weapon if the first and second electronic alignment sensors indicate relative vertical misalignment.

28 Claims, 10 Drawing Sheets

(56) References Cited

U.S. PATENT DOCUMENTS

| | | | | |
|---|---|---|---|---|
| 2004/0244262 | A1* | 12/2004 | Paige | F41G 1/54 42/121 |
| 2005/0285371 | A1* | 12/2005 | Ramsey | B60D 1/06 280/477 |
| 2007/0113460 | A1 | 5/2007 | Potterfield et al. | |
| 2010/0332181 | A1* | 12/2010 | Jones | F41G 3/32 702/151 |
| 2012/0117849 | A1* | 5/2012 | Thomas | F41G 1/545 42/130 |
| 2012/0260555 | A1 | 10/2012 | Potterfield et al. | |
| 2013/0139566 | A1* | 6/2013 | Jones | G01B 5/25 73/1.75 |
| 2014/0002812 | A1* | 1/2014 | Kepler | G01B 11/272 356/138 |
| 2018/0274886 | A1* | 9/2018 | Goddard | F41G 1/545 |

OTHER PUBLICATIONS

Internet Screen Shots of Commercial Products, dated Aug. 31, 2017.

* cited by examiner

KIT AND METHOD FOR ALIGNING A SCOPE ON A SHOOTING WEAPON

CROSS REFERENCE TO RELATED APPLICATIONS

The present application is a Non-Provisional Patent Application and claims priority to U.S. Provisional Patent Application Ser. No. 62/649,656, filed Mar. 29, 2018, which is incorporated by reference herein.

TECHNICAL FIELD

The present disclosure relates generally to a kit and method for aligning a scope on a weapon. In other aspects, the present disclosure relates to a kit and method employing calibrated electronic alignment sensors to align such a scope.

BACKGROUND

Shooting weapons such as guns and crossbows may include telescopic sights (herein referred to as "scopes") to assist the shooter in properly aligning the shooting weapon with a target before shooting. Such scopes are generally mounted to the top of the shooting weapon vertically over the barrel via mounting hardware such as two split-ring clamps or the like. The hardware may be attached to the weapon via screws, via a mounting rail interface, etc. Once attached to the weapon by the mounting hardware, the scope will be generally aligned with the barrel due to the configuration of the weapon, mounting hardware and scope. However, accurate use of such a scope generally requires a "sighting in" of the scope to align it horizontally and/or vertically with the barrel more precisely. Also, depending on a particular desired target distance and shooting conditions, it is often desirable to further adjust the scope alignment relative to the barrel so that a target centered in the scope is hit.

Most scopes include sighting assisting elements called reticles, which are small markings visible to the shooter when looking through the scope. One common reticle includes two perpendicular "cross-hairs" intended to be oriented with one line being vertical and one line being horizontal. For accurate shooting, it is generally desired to have the target in the scope appear to the user to be the point where the cross-hairs cross before firing. On many scopes, rotatable knobs called turrets are provided to allow the user to adjust the scope central axis either horizontally (i.e., windage adjustment) or vertically (i.e., elevation adjustment) to effectively move the apparent location of the reticle to the user. Therefore, if a shot is taken at a target but the shot falls several inches below the target, the user would turn the elevation turret sufficiently to move the reticle until further shots no longer fall below the target. Such sighting in can be done at one or more target distances (e.g., 100 yards, 200 yards, etc.) until a scope is aligned as desired (sometimes called "zeroed.")

Some reticles include additional markings such as range indicating circles, cross-hatches, etc., to help further refine targeting during sighting in or later shooting. The reticle additional markings may be arranged in units such as MOA (minute of angle) or mils (milliradians), depending on the scope. If so, the turrets often provide a haptic and audible click when passing certain adjustment units to assist with aligning the scope. For example, rotating an MOA turret might adjust the scope by ¼ MOA per click, which would correspond to ¼ inch movement of the shot relative to the target at 100 yards, or ½ inch at 200 yards. By rotating one of the turrets, the user is moving the aim of the scope via a mechanism arranged between the turret and the scope. After the scope is sighted in to a desired level of accuracy and the user is later firing the gun at different targets, the user can use the reticles with hashmarks, circles, etc., to adjust the aim by moving the perceived location of a desired target away from the center of the cross-hairs or the user can use the turrets to dial in an adjustment that places the desired target at the center of the cross-hairs (both based on information as to distance to target or conditions).

Regardless of the scope attachment hardware, type of reticle, reticle submarkings, etc., it is important to the sighting in and later use of the scope that the scope/reticle itself is aligned. A misaligned reticle (sometimes called "canted" reticle) leads to inaccuracy.

For example, FIG. 1 shows a view s through a conventional cross-hair scope with hashmarked cross-hairs (elevation e and windage w) aligned with respective Cartesian-type directions (vertical v and horizontal h). FIG. 2 shows the same view s, but with cross-hairs canted by angle a indicating that the scope is rotated clockwise from the user's viewpoint around its sighting axis relative to the Cartesian-type directions. If the reticle cross-hairs of a scope are canted in such fashion, the sighting-in adjustments and the in-field targeting adjustments (whether simply visual or via turret adjustment) will be off accordingly. Reticle alignment becomes even more important to accuracy of a shot when its target is further away.

Typically, reticle alignment includes, after attaching the mounting hardware to the gun and placing the scope (loosely) in the mounting hardware, aligning the scope by rotating the scope axially until that the reticle is located in a desired orientation. If the reticle is a cross-hair reticle, the desired orientation has the vertical line oriented vertically. Once aligned the mounting hardware can be tightened around the scope (for example, by fully tightening screws or clamps holding the scope in place in the mounting hardware).

Achieving such reticle alignment has been a multistep process. First, the shooting weapon is loosely placed on a bench rest or in a gun vise. Then, the shooting weapon is oriented so that the barrel is aligned so that a vertical plane through the central axis of the gun barrel is vertical. This alignment is typically done using a bubble level placed on the shooting weapon. Once the shooting weapon is aligned, if the gun vise/bench rest can be tightened, such is done to hold the shooting weapon in place. Next, the scope (loosely aligned to the shooting weapon already in a scope mount) is oriented, typically by placing the bubble level on a flat upper alignment surface of the scope provided for receiving a bubble level or the like. Typically, the flat upper surface is located along the top of the elevation turret. Scope manufacturers generally ensure such flat upper surface is oriented so as to be perpendicular to a vertical reticle line (such as a vertical cross-hair) and parallel to a horizontal reticle line (such as a horizontal cross-hair). Once the upper surface is level (with the vertical reticle portion accordingly being vertical), the scope is considered aligned to the weapon, and the mount can be tightened to hold the scope in place.

Such a method may introduce several possible errors. First, bubble levels are generally not highly accurate, and may introduce errors on the order of one degree or greater. Second, if the shooting weapon itself is not accurately aligned initially, then the step of aligning the scope reticle afterward would be futile by the degree of initial misalignment. Using a bubble level for both alignments compounds the potential for error. Bumping or disturbing the shooting weapon once aligned, if noticed, requires the user to restart the process and, if not noticed, leads to further inaccuracy. Even if a levelling device more accurate than a bubble level were used (such as what is commonly called a "digital protractor"), the above method still introduces potential inaccuracy due to the multi-step alignment process and possibility of disturbing the initial alignment before the reticle alignment is complete.

Thus, while existing scope alignment devices and methods generally work for their intended purposes, improvements to such devices and/or methods that were less cumbersome, less inaccurate, and/or less time consuming, and/or that addressed one of the drawbacks of existing devices, systems, or methods, and/or other issues, would be welcome.

SUMMARY

According to certain aspects of the disclosure, a kit for aligning a scope of a shooting weapon may include, for example, a first electronic alignment sensor; a second electronic alignment sensor; a user control device having an input/output interface in communication with the first and second electronic alignment sensors; and at least one display; the first and second electronic alignment sensors being calibratable so that when the first electronic alignment sensor is located on an index point on the shooting weapon and the second electronic alignment sensor is located on the scope, the display indicates whether relative vertical alignment exists between the first and second electronic alignment sensors. Various options and modifications are possible.

According to other aspects of the disclosure, a kit for aligning a scope on a shooting weapon usable with a personal communication device may include, for example, a first electronic alignment sensor; a second electronic alignment sensor; a computer program downloadable to and executable on the personal communication device, the first and second electronic alignment sensors being communicatable with the personal communication device and the computer program; and at least one display; the first and second electronic alignment sensors being calibratable so that when the first electronic alignment sensor is located at an index point on the shooting weapon and the second electronic alignment sensor is located on the scope, the display indicates whether relative vertical alignment exists between the first and second electronic alignment sensors. Various options and modifications are possible.

According to certain other aspects of the disclosure, a method of aligning a scope located a shooting weapon may include includes the steps of: fixing the shooting weapon in place; placing a first electronic alignment sensor and a second electronic alignment sensor on the shooting weapon; calibrating the first and second electronic alignment sensors; placing the second electronic alignment sensor on the scope; and adjusting an alignment of the scope relative to the shooting weapon if the first and second electronic alignment sensors indicate relative vertical misalignment. Various options and modifications are possible.

BRIEF DESCRIPTION OF THE DRAWINGS

These and other features of the disclosure will be more readily understood from the following detailed description of the various aspects of the disclosure taken in conjunction with the accompanying drawings that depict various aspects of the disclosure.

DETAILED DESCRIPTION

Figure 1:
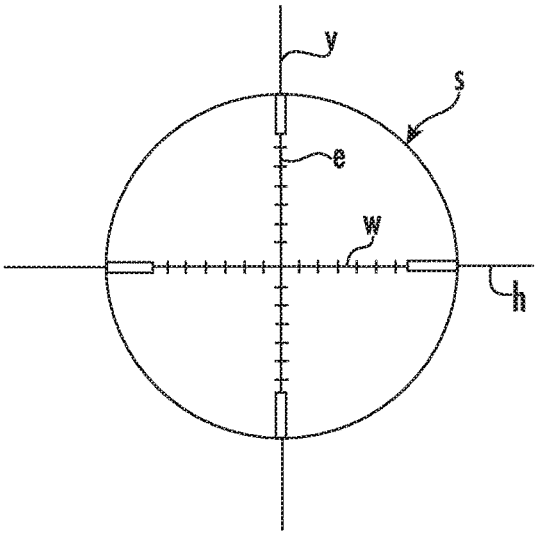
FIG. 1 PRIOR ART
FIG. 1 is a diagrammatic view of a reticle scope with the reticle aligned to Cartesian-type vertical and horizontal directions.

Detailed reference will now be made to the drawings in which examples embodying the present disclosure are shown. The detailed description uses numeral and letter designations to refer to features in the drawings. Like or similar designations in the drawings and description have been used to refer to like or similar parts of the disclosure.

The drawings and detailed description provide a full and enabling description of the disclosure and the manner and process of making and using it. Each embodiment is provided by way of explanation of the subject matter not limitation thereof. In fact, it will be apparent to those skilled in the art that various modifications and variations may be made to the disclosed subject matter without departing from the scope or spirit of the disclosure. For instance, features illustrated or described as part of one embodiment may be used with another embodiment to yield a still further embodiment.

Figure 2:
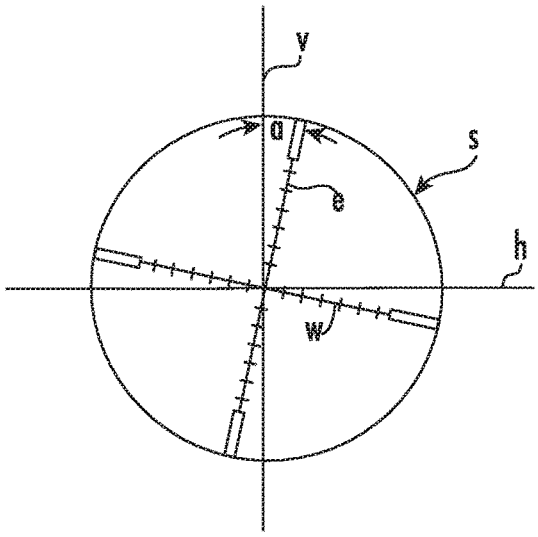
FIG. 2 PRIOR ART
FIG. 2 is a diagrammatic view as in FIG. 1, but with the reticle misaligned.

Generally speaking, the present disclosure is directed to aspects of kits and methods for aligning a scope on a shooting weapon, such as a gun or a crossbow. As shown in FIGS. 1 and 2, the goal of such alignment is to move an out of alignment scope (see, e.g., FIG. 2 where cross-hairs e and w are misaligned from the vertical v and horizontal h by an angle a) into Cartesian coordinate alignment (see FIG. 1 where cross-hairs e and w are respectively aligned with vertical v and horizontal h axes). It should be understood that the present disclosure is not limited to any particular type of scope, any cross-hair arrangement, and/or the existence of cross-hairs or other indicators in the scope.

Figure 3:
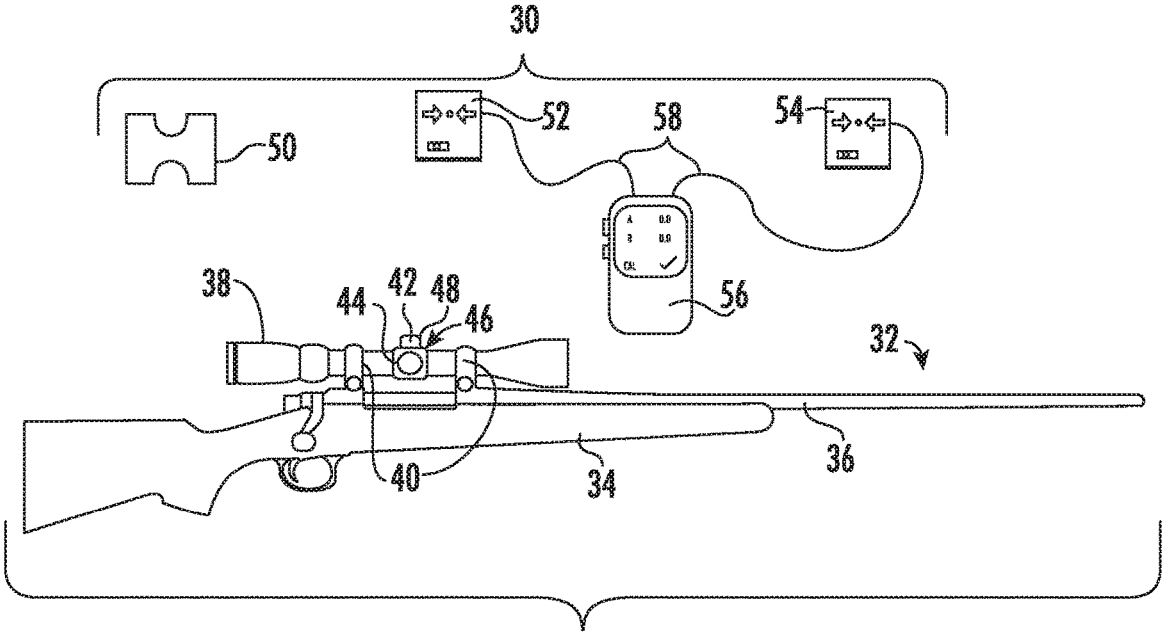
FIG. 3 is a side view of a gun with a scope and elements of a one example of kit for aligning the scope according to certain aspects of the present disclosure.
Figure 4:
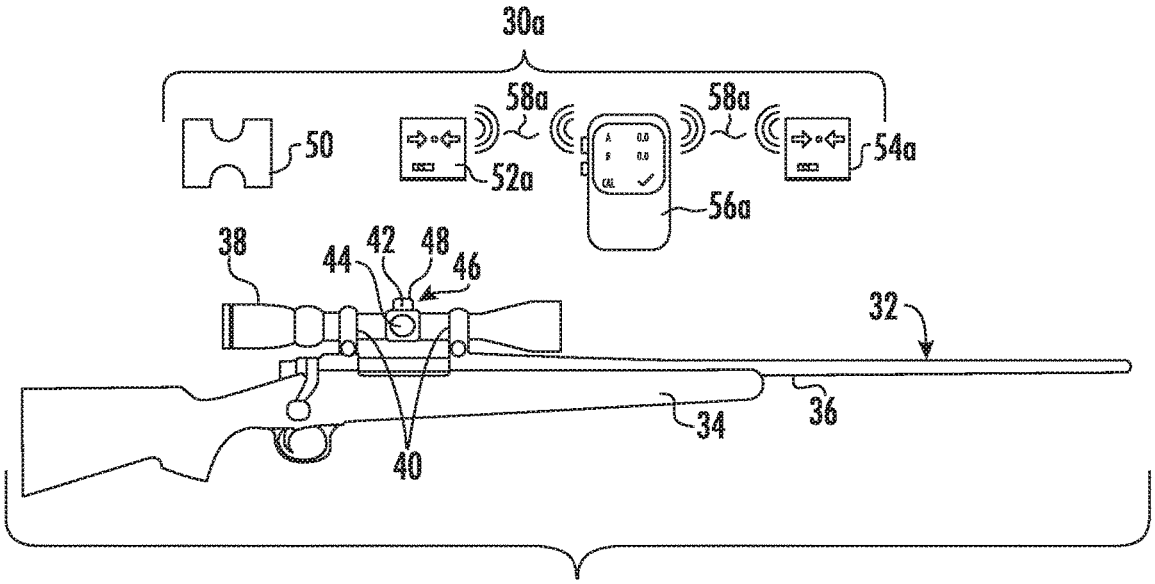
FIG. 4 is a side view of a gun with a scope and elements of another example of kit for aligning the scope according to certain aspects of the present disclosure.

FIGS. 3-24 show examples of certain kits and methods for aligning a scope on a gun. FIG. 3 shows a kit 30, where certain of the elements are connected by wired communication. FIG. 4 shows a modified kit 30*a*, where the corresponding elements are connected by wireless communication. Shooting weapon (gun 32) is illustrated as a rifle having a stock 34, a barrel 36, and a scope 38 attached to gun 32 via mounting rings 40. Knob 42, 44 in a turret structure 46 on scope 38 adjust elevation and windage, respectively, relative to gun 32 and in particular barrel 36. Knob 42 has a flat upper surface 48, which will be discussed below.

It should be understood that gun 32 and scope 38 are representational examples only, and any conventional matchable shooting weapon (e.g., gun or cross-bow) and visual or electronic scope combination could be employed according to the teachings of the present disclosure.

As shown in FIG. 3, kit 30 includes a base member 50, a first electronic alignment sensor 52, a second electronic alignment sensor 54, a user control device 56, and a connection (in FIG. 3, wires 58, in FIG. 4, wireless communication 58*a*) between the electronic alignment sensors and the user control device.

The first and second electronic alignment sensors 52,54 may be conventional electronic elements sometimes known as "digital protractors," available from many suppliers. Such sensors generally measure orientation relative to a fixed frame (horizontal and vertical Cartesian coordinates, for example) and provide a digital readout as to orientation, typically in degrees or fractions of degrees. Such sensors often include a "zero" or "calibrate" feature, in which for example by pressing a button or providing other input, the sensor can be adjusted so that its initial reference orientation is considered the reference frame (i.e., device is "zeroed" at that orientation) and then when the sensor is moved the digital readout indicates degree of misalignment (if any) with the initial reference orientation, instead of with reference to a horizontal and vertical coordinate set.

Figure 6:
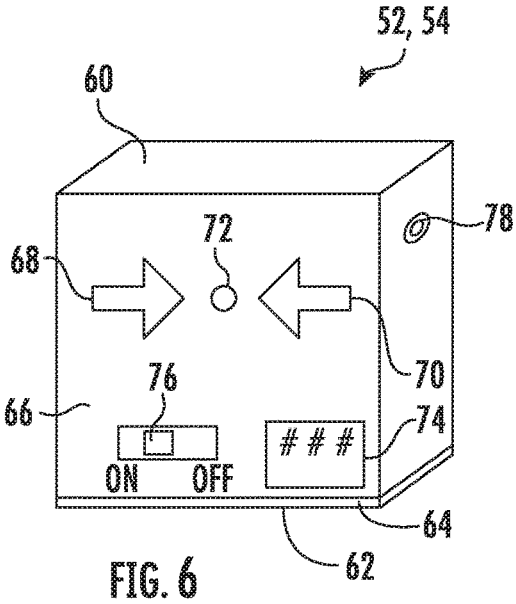
FIG. 6 is an isometric view of an electronic alignment sensor usable with the kits of FIGS. 3 and 4.

As shown in FIG. 6, such sensors 52,54 may have generally rectangular housings 60 with a flat bottom 62, which may optionally include a magnetic or ferric (magnetically attractable) plate 64. A front portion 66 may include a display area, either made of discrete illuminable elements (as shown) or made of a display screen such as an LCD, LED, etc. Arrows 68,70 indicate direction toward alignment, and indicator 72 may illuminate when aligned within a desired range. Elements 68,70,72 may illuminate in different colors or in different patterns (slow flash, fast flash, steady, etc.) to provide information to a user as to degree of alignment. A numerical indicator (such as an LED or LCD device) 74 may provide an indication of alignment in degrees, fraction of degrees, etc. Sensors 52,54 may be battery operated, either rechargeable or removable, and a conventional sliding on-off switch 76 may be provided. If desired, zeroing may be provided by pressing switch 76 inward, or another switch or button (not shown) may be provided. A connector port 78 may be provided for connection to a wired connector 58, for charging a battery, etc. Port 78 may be configured for tip/ring connection, USB, Mini USB, Micro USB, USB-C, Firewire, Lightningbolt, dongle, or any other suitable electronic and/or data connection, wired or wireless, to achieve the functions described herein.

Such sensors 52,54 may provide a resolution of no more than 1.0 degree, and preferably a fraction of 1.0 degree, such as 0.1 degree, or 0.01 degree or the like. The more precise the sensors, the more precise the alignment of the scope.

Figure 5:
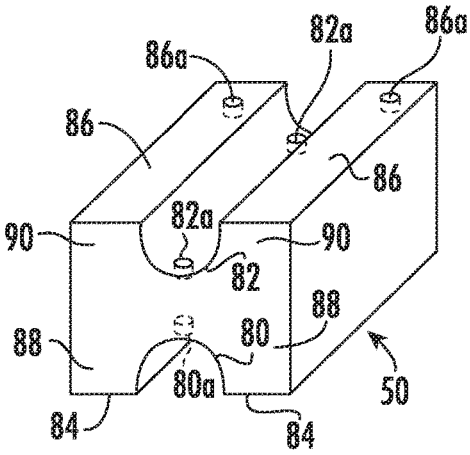
FIG. 5 is an isometric view of an index block usable with the kits of FIGS. 3 and 4.

Base member 50 may be employed as a platform on which sensors 52,54 may be placed during alignment. As shown in FIG. 5, base member 60 has at least one arcuate cavity 80, and may have two cavities 80,82 of different diameters on different surfaces. The cavities are sized for placement of base member 50 atop gun 32 with a cavity 80 or 82 atop differently-sized barrels 36 and a surface 84,86 of arms 88,90 adjacent the cavity resting atop the stock 34 at a forearm location (see, e.g., FIGS. 10-14). If desired, magnets 80*a*,82*a* may be located in cavities 80,82 to help hold base member 50 in place. Also, magnets 84*a*,86*a* may be located along surfaces 84,86 to help hold a sensor 52,54 in place on base member 50 during alignment. Depending on orientation, if surface 84 is (oriented downward) contacting stock 34, surface 86 is (oriented upward) for supporting the sensors 52,54, and vice versa. As will be noted below, elements of the base member 50 (e.g., the cavity) may be unitarily combined with the sensors 52,54 to achieve a kit with fewer components.

Figure 7:
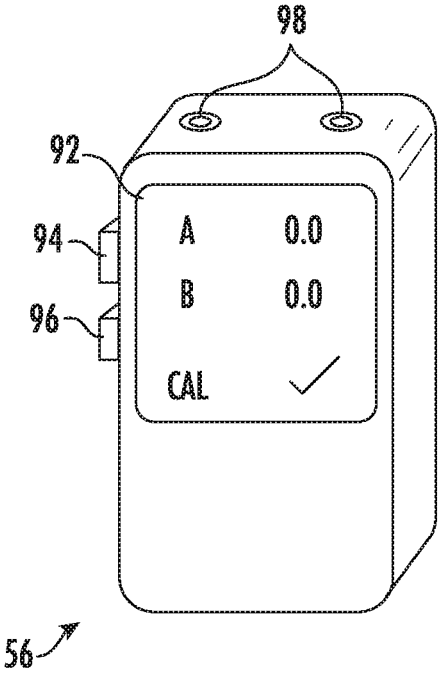
FIG. 7 is an isometric view of a user control device with one type of informational display usable with the kits of FIGS. 3 and 4.
Figure 8:
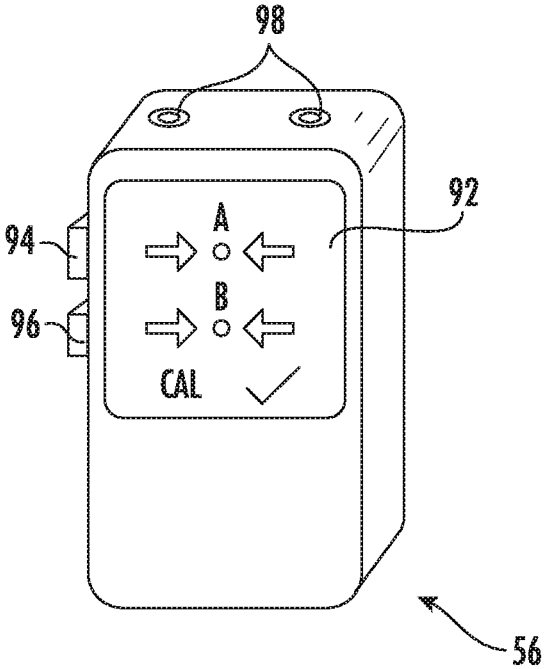
FIG. 8 is an isometric view of a user control device with another type of informational display usable with the kits of FIGS. 3 and 4.

As shown in FIGS. 3 and 7, first example of user control device 56 has an input/output interface (e.g., screen 92 and/or buttons 94,96) in communication with the first and second electronic alignment sensors 52,54. Screen 92 may display information such as the orientation of first sensor 52 ("A 0.0"), second sensor 54 ("B 0.0"), and whether the two sensors 52,54 have been calibrated together (i.e., zeroed) ("Cal √"). Other status information can be shown on screen 92, if desired. Display 92 may duplicate, replace, or supplement the information shown on sensors 52,54, and vice versa. FIG. 8 shows an alternate display 92*a* with differing information formatting that could replace or be selectable relative to display 92, if desired. Device 56 may include ports 98 for wired connection or charging, in any format, as described above relative to sensors 52,54.

User control device 56 may include physical buttons 94,96 for on-off-function and calibration/zeroing function, if desired. Alternatively, screen 92 may comprise a touch-screen input-output device in addition to or instead of one or both physical buttons. User control device 56 may alternately comprise a smartphone device, a tablet device or a computer, all running a suitable application or other program stored in a memory or accessed on-line for managing the steps to be defined below.

Figure 9:
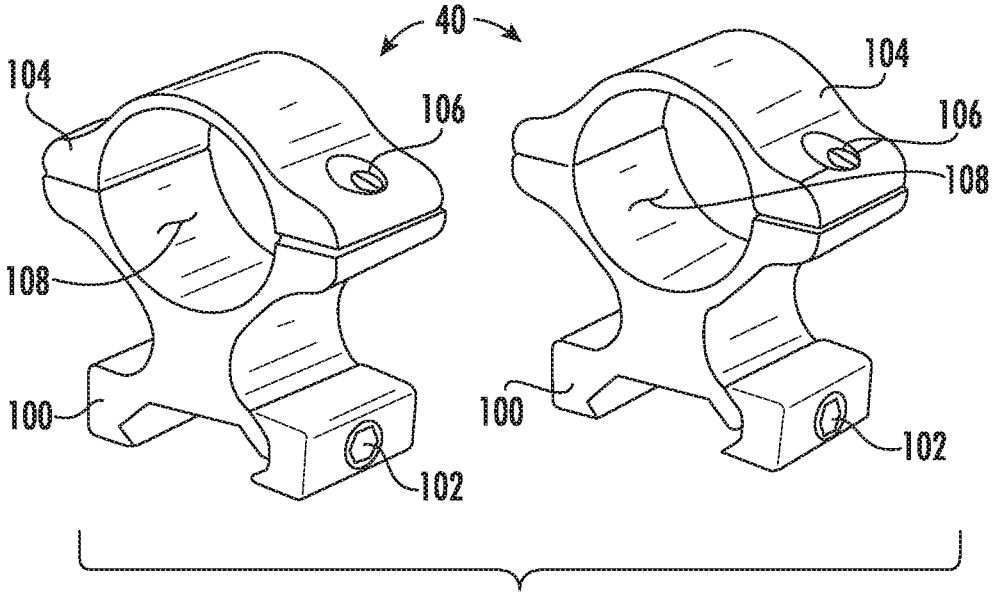
FIG. 9 is an isometric view of one example of rings used to retain a scope on a gun.

As noted, mounting rings 40 of FIG. 9 are examples of rings used to attach a scope to a gun. Typically, rings include a base portion 100 attachable to a gun via fasteners such as screws 102 and a top portion 104 attachable to the base portion 100 by fasteners such as screws 106. By tightening screws 106 with a scope in a cavities 108 created by portions 100,104, the scope is held tightly and will not rotate. By loosening screws 106 slightly, the scope can be rotated within cavities 108 so that it can be aligned. By doing so while using the teachings of the present disclosure, the scope can be aligned with high precision, so that for example, cross-hairs reach the desired position of FIG. 1. Then, screws 106 can be tightened, thereby holding the scope in the aligned orientation.

FIGS. 10-14 show one example of a method for aligning a scope utilizing the structures described above. As shown, gun 32 is placed on a steady object 110 such as a bench of gun vise (shown schematically in FIG. 10). Base member 50 is oriented so that cavity 80 (or best suited cavity 80 or 82) is placed over barrel 36 and base member contacts and sits steadily on stock 34. Both electronic alignment sensors 52,54 are attached to user control device 56 via connections 58 (wired or wirelessly). Preferably, base member 50 is located near or in contact with scope 38 to help square base member 50 and sensors 52,54 to gun 32.

Figure 11:
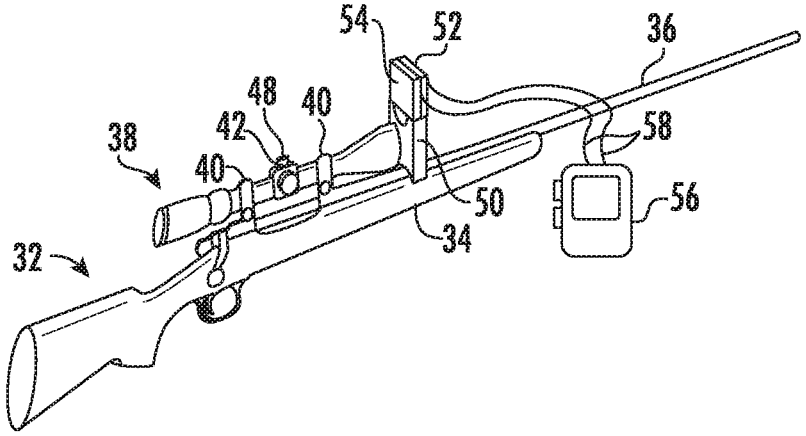
FIG. 11 is an isometric view of a second step of using the kit of FIG. 3.

FIG. 11 shows sensors 52,54 being placed on base member 50. At this point the sensors 52,54 can be "zeroed" or "calibrated" so both read 0.00 degrees—perfectly aligned with each other but not necessarily vertical and horizontal Cartesian coordinates. It is not critical that gun 32, base member 50, and/or sensors 52,54 be precisely oriented with respect to vertical and horizontal. Reasonably close alignment will suffice. Calibration can be done via button 96 on user control device 56, or by equivalent entry to a touch screen, computer, etc. Sensors 52,54 and other items directly touching gun 32 and scope 38 need not be touched or moved during calibration.

Figure 12:
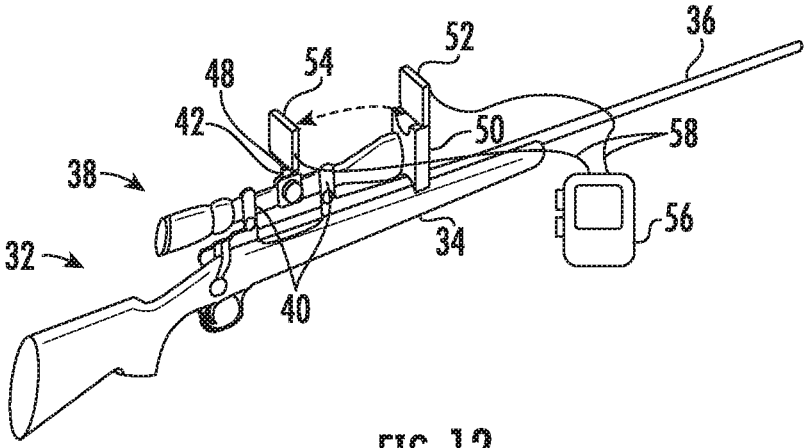
FIG. 12 is an isometric view of a third step of using the kit of FIG. 3.

FIG. 12 shows moving sensor 54 to turret knob 42 top surface 48 while maintaining sensor 52 on base member 50. Such movement should be made carefully so as not to disturb sensor 52. Magnets 80*a*/82*a*/84*a*/86*a* and plate 64 can all help maintain steady positioning of other items while moving sensor 54. Once sensor 54 is moved off base member and placed on surface 48, a display on one or more of the sensors and/or user input device (as desired) will indicate to the user the degree of misalignment, if any, between sensors 52 and 54.

Figure 13:
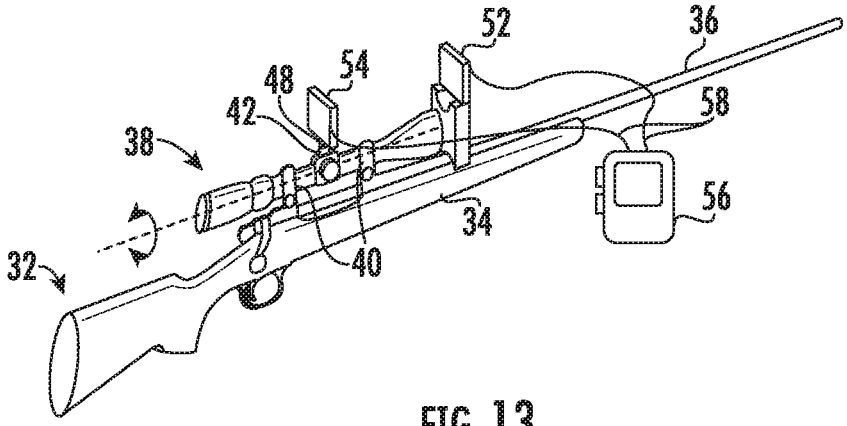
FIG. 13 is an isometric view of a fourth step of using the kit of FIG. 3.
Figure 14:
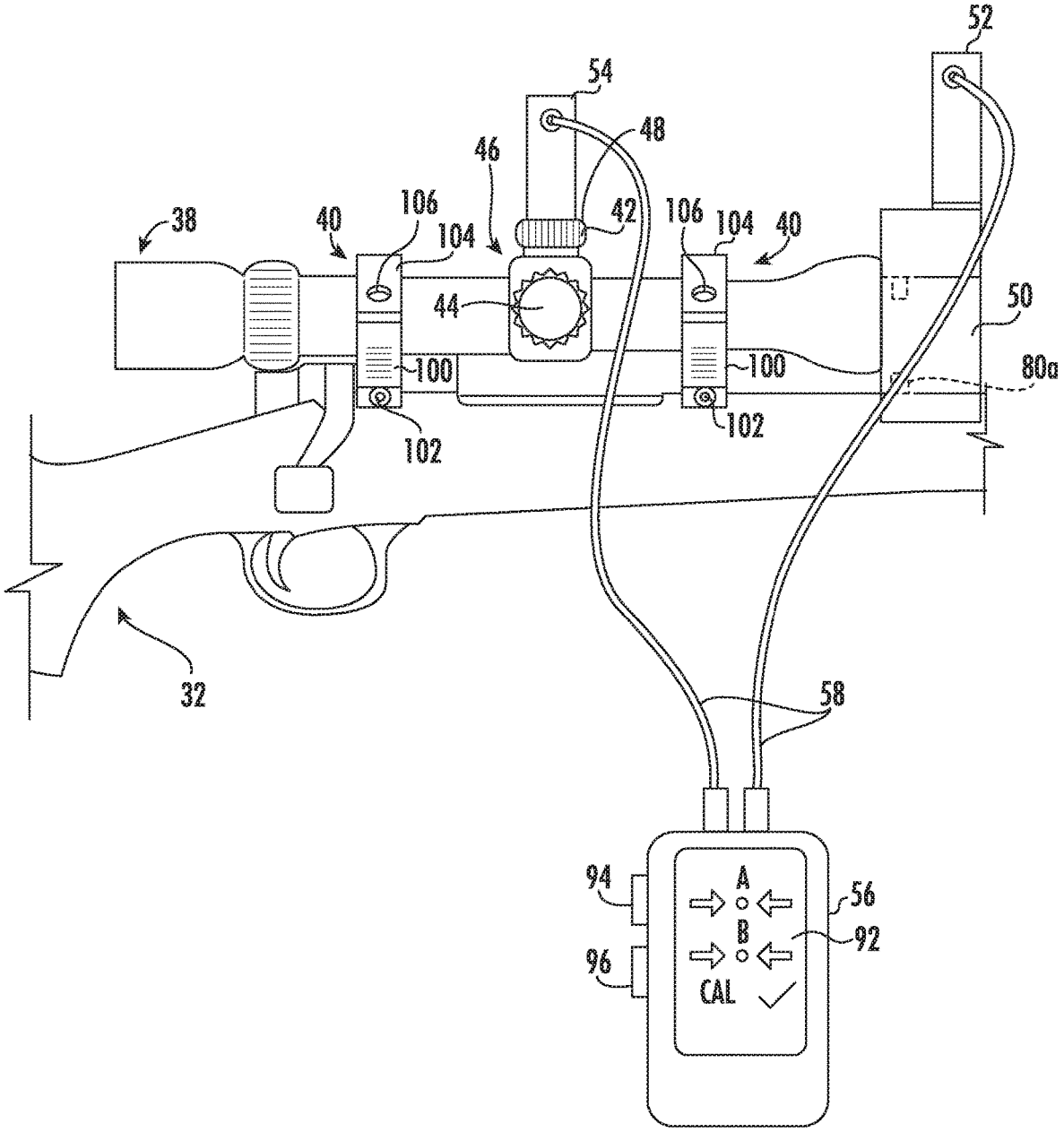
FIG. 14 is a close-up, partial side view of the fourth step of using the kit as in FIG. 13.

FIG. 13 shows, assuming sensors 52,54 indicate a degree of misalignment, rotation of scope 38. Such rotation is made (gently and carefully) while watching the display(s) that indicate degree of (mis)alignment so that real time information is provided as to degree of alignment until acceptable alignment is achieved. At that point, screws 106 can be carefully tightened, thereby securing scope in place on gun in suitable alignment.

Note that the above method may be limited by the precision of the gun itself (degree of alignment of forearm portion of gun stock 34 and barrel 36, and the degree of alignment of cross-hairs in scope 38 with turret 46 and surface 48). However, as a practical matter, such elements are generally manufactured to a very high degree of precision by gun manufacturers, so that use of the present subject matter provides substantial benefits in aligning the scope to the gun.

Figure 15:
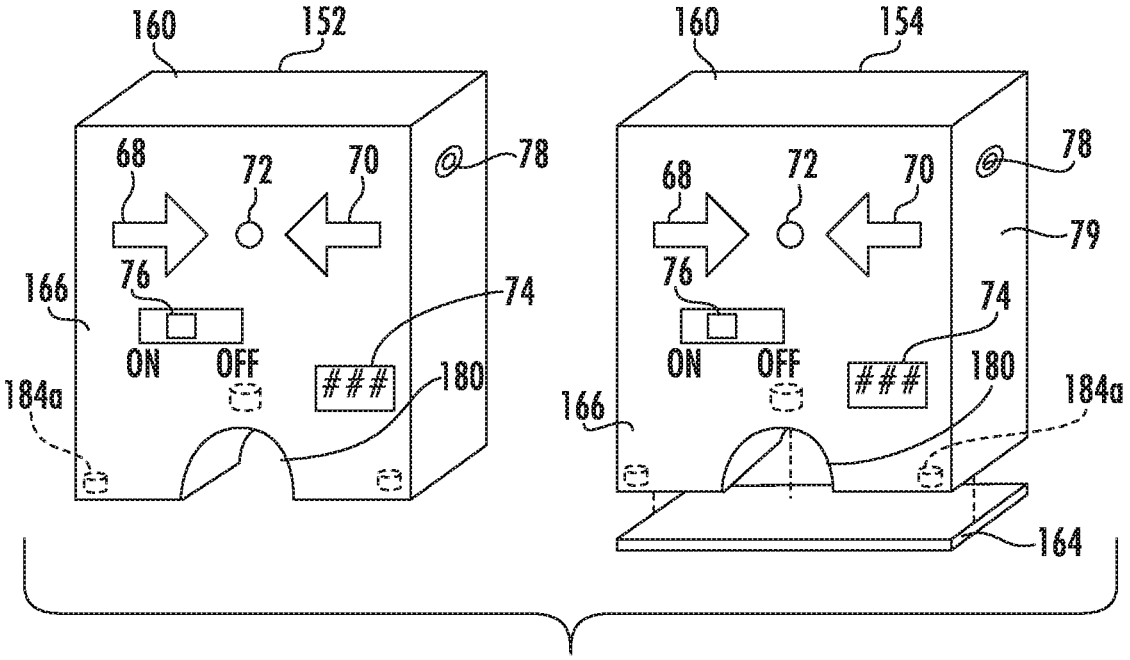
FIG. 15 is an isometric view of alternate electronic alignment sensors usable with a kit according to other aspects of the disclosure.

FIG. 15 shows an alternate design for sensors 152,154, in which a cavity 180 is located in the sensors and no base member (such as 50) is required. If desired (not shown) two cavities may be provided in different surfaces of sensors 152,154, as shown above for base member 50. Plate 164 may be removable from sensor 154, optionally attracted by magnets 184*a*, for use when sensor 154 is placed on surface 48 of turret 46. FIGS. 16-19 show a method of use of a kit using such sensors 152,154.

Figure 10:
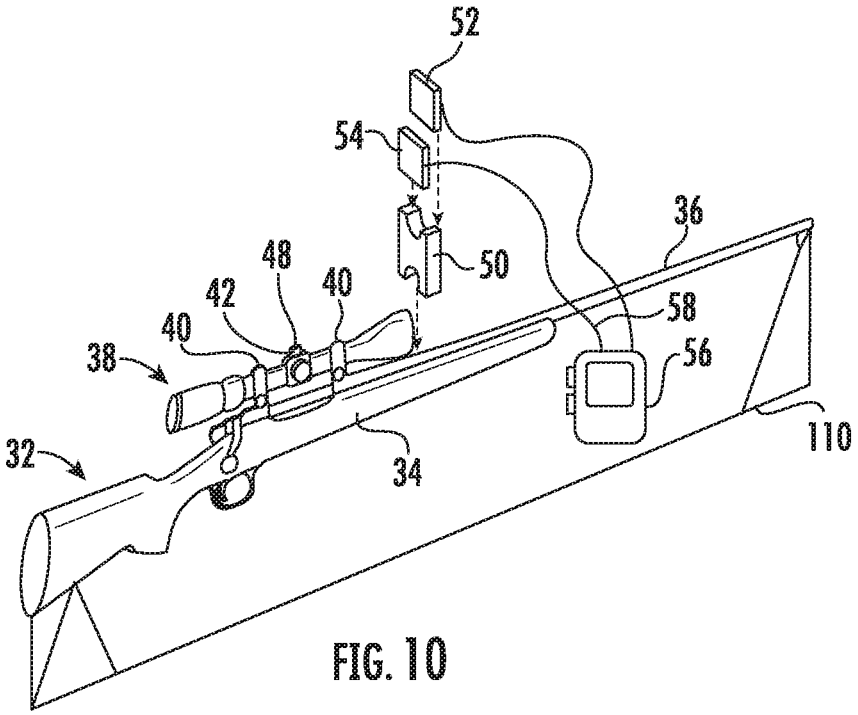
FIG. 10 is an isometric view of a first step of using the kit of FIG. 3.
Figure 16:
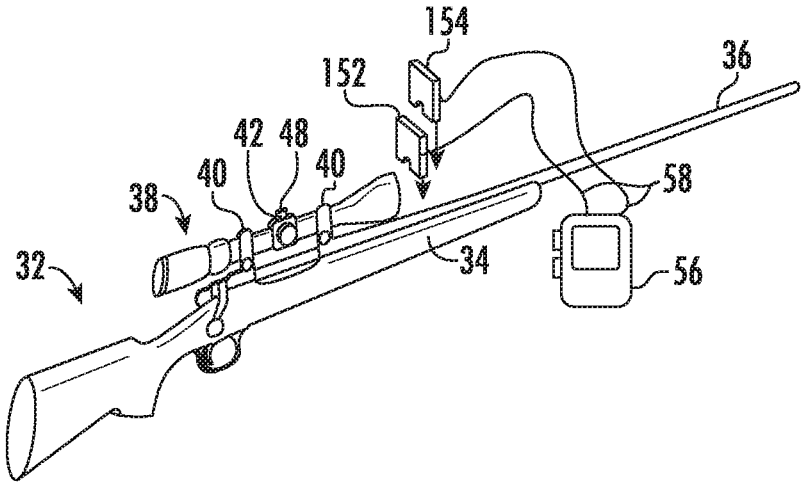
FIG. 16 is an isometric view of a first step of using the kit of FIG. 3 substituting the electronic alignment sensors of FIG. 15.

In FIG. 16, sensors 152,154 are placed on gun 32 in the location base member 50 had been placed in FIG. 10. Cavities 180 allow sensors 152,154 to reach the orientation of FIG. 17.

Figure 17:
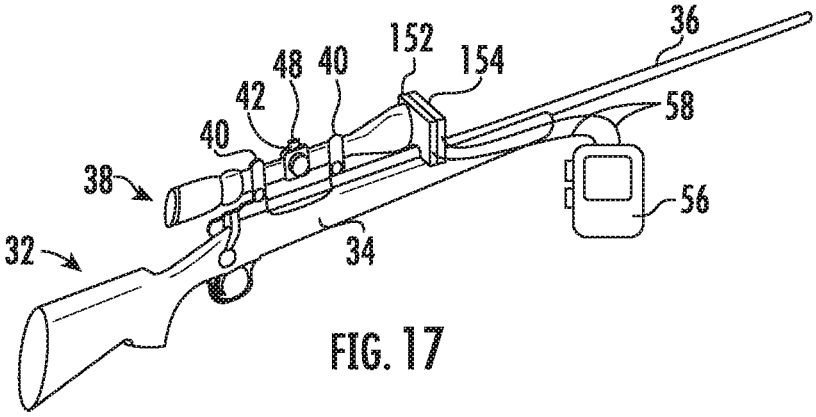
FIG. 17 is an isometric view of a second step of using the kit of FIG. 3 substituting the electronic alignment sensors of FIG. 15.

Once in the position of FIG. 17, sensors 152,154 are calibrated as above, so as to equalize the readout of both sensors and "zero" them.

Figure 18:
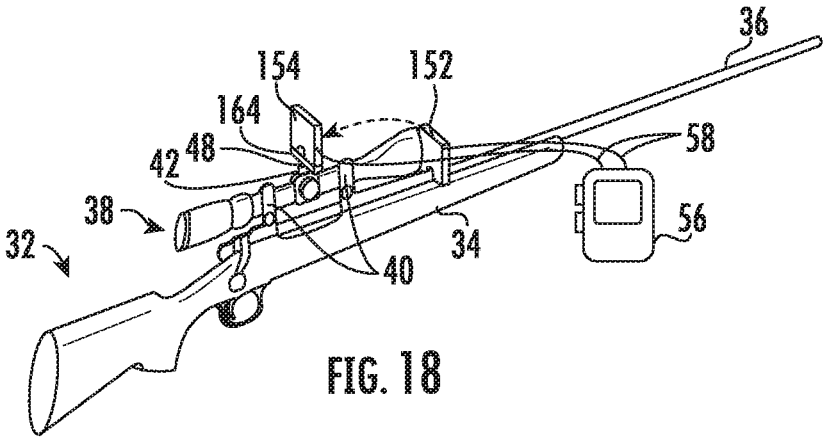
FIG. 18 is an isometric view of a third step of using the kit of FIG. 3 substituting the electronic alignment sensors of FIG. 15.

In FIG. 18, sensor 154 is moved to surface 48 on turret 46 of scope 32, using plate 164 if required for balance (to cover cavity 180 with a flat surface).

Figure 19:
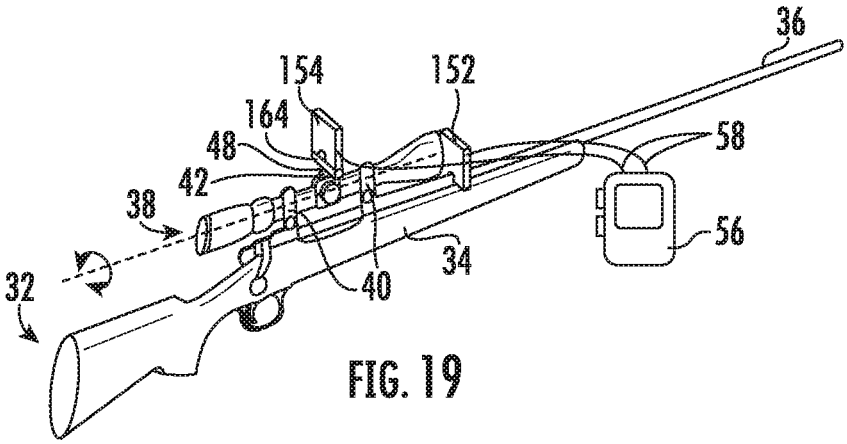
FIG. 19 is an isometric view of a fourth step of using the kit of FIG. 3 substituting the electronic alignment sensors of FIG. 15.

In FIG. 19, scope 38 is rotated slightly until sensors 152,154 indicate relative alignment, and screws 106 are tightened thereby securing scope 38 in alignment with gun 32.

FIGS. 20-24 show an alternate kit and method for alignment including an optional squaring plate 181 for aligning sensor 154 placed atop scope 38 with the central axis of the scope. As shown, for example in FIG. 17, when sensors 152, 154 are calibrated in front of scope 38, the rectangular nature of the sensors and the flat front of the scope ensure that the sensors are aligned perpendicular to the scope central axis (and accordingly to gun 32 because the scope is already aligned). When sensor 154 is placed atop turret knob 42, as shown in FIGS. 18 and 19, it may not be placed perfectly parallel to its previous position of FIG. 17 and accordingly not parallel to sensor 152. In other words, sensor 154 could be undesirably rotated an angle x (FIG. 23) around a vertically extending axis to an orientation not parallel with sensor 152. Squaring plate 181 allows the user to orient sensor 154 in an orientation parallel to sensor 152 (within tolerances of scope and sensor dimensional precision).

Figure 20:
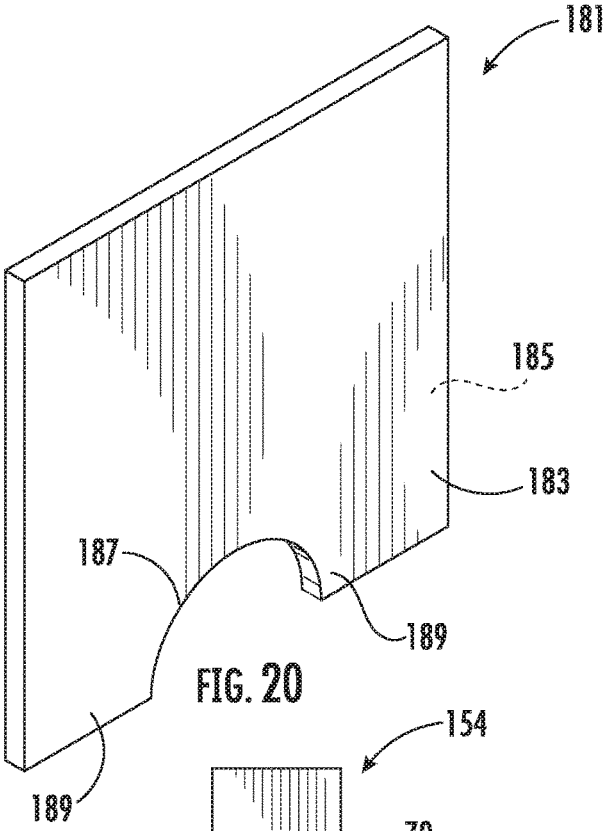
FIG. 20 is an isometric view of an optional squaring plate useful with any of the above kits.
Figure 21:
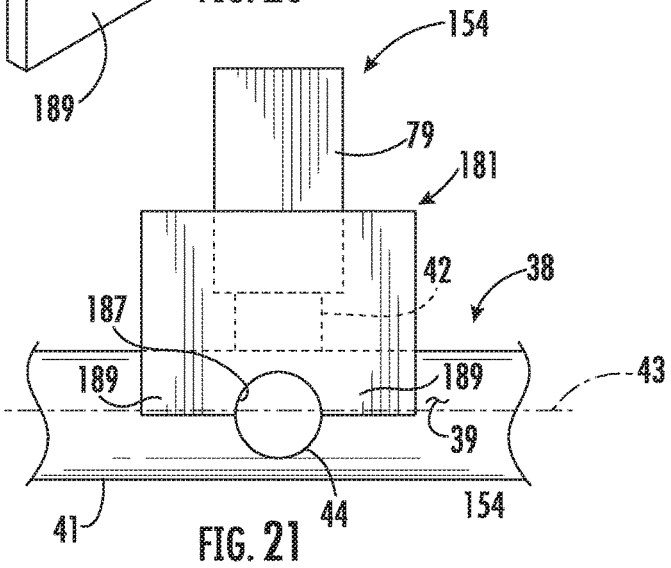
FIG. 21 is a diagrammatic side view of the squaring plate in use on the scope.
Figure 22:
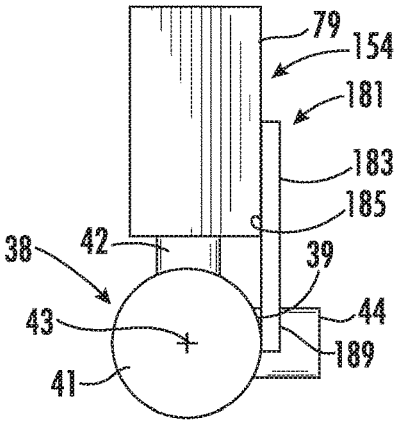
FIG. 22 is a diagrammatic rear view of the squaring plate in use in the scope.
Figure 23:
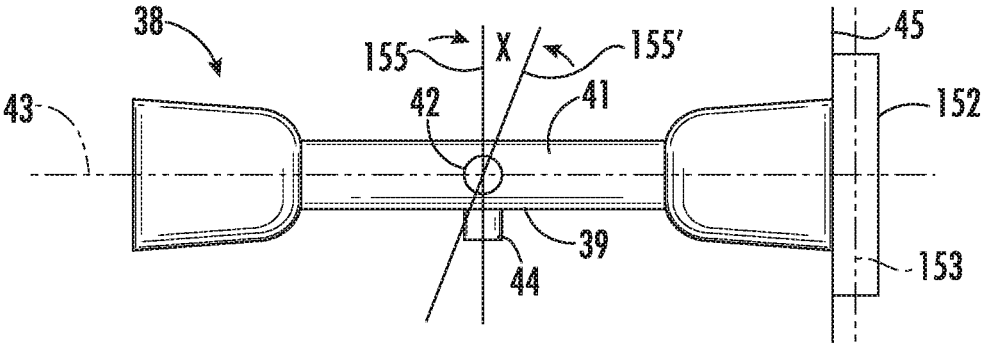
FIG. 23 is a diagrammatic top view showing a center line of an electronic alignment sensor being aligned with the central axis of the scope and being made parallel to the front of the scope.

FIG. 20 shows that squaring plate 181 has a front surface 183, a rear surface 185, and a cavity 187 at a bottom edge sized for placement on the windage turret knob 44 of scope 38. Legs 189 are located on sides of cavity 187, and the portion of rear surface 185 on or near the legs contacts the side 39 of barrel 41 of scope 38. Note that scope 38 in FIGS. 21-23 is simplified in illustration with regard to deleting turret structure 46 for clarity. If a protruding turret structure 46 were present, such would be considered part of scope 38 and side of such structure could if properly dimensioned substitute for side 39 of scope barrel in alignment.

Squaring plate 181 and cavity 187 can be made in different dimensions to fit differing scope models, and in particular the diameter of turret knob 44 (which dictates the size of the cavity) and the height of top surface 48 of turret knob 42 on which sensor 154 is placed above turret knob 44 (which dictates the height required for the squaring plate to reach and contact sensor 154). Squaring plate 181 may be made of a relatively rigid material such as metal, plastic, etc.

As shown in FIGS. 21 and 22, placement of squaring plate 181 on turret knob 44 with legs 189 against scope barrel 41 causes back surface 185 of squaring plate 181 to align with the central axis 43 of scope 38. By contacting and aligning side 79 of sensor 154 with rear surface 185, center line 155 of sensor 154 (which is perpendicular to side 79) will be also perpendicular to central axis 43 of scope 38. Note FIG. 23 illustrates correction of aligned center line 155 from misaligned orientation 155' to its aligned condition (a difference of angle x). In such orientation, sensor center line 155 will be parallel with front surface 45 of scope 38, and parallel to center line 153 of sensor 152 in contact with front surface 43. Such alignment of sensor 154 provides further enhanced accuracy.

Figure 24:
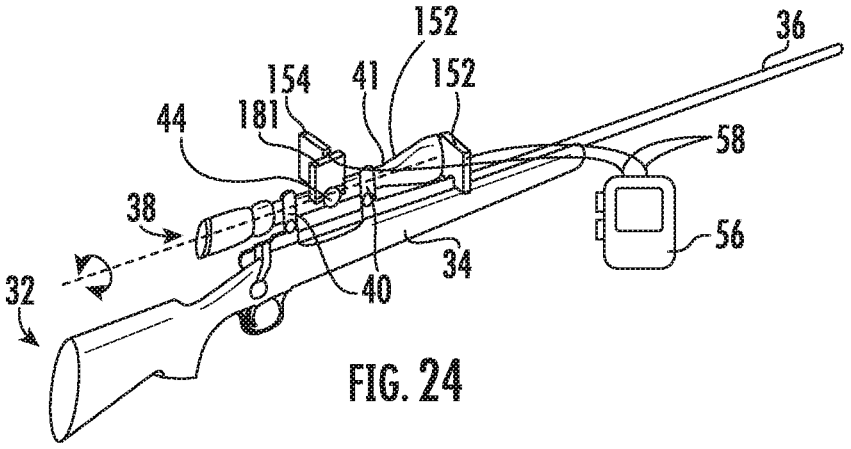
FIG. 24 is an isometric view of a fifth step (following that of FIG. 19) of using the kit of FIG. 3 substituting the electronic alignment sensors of FIG. 15, and using the squaring plate.

FIG. 24 shows squaring plate 181 in use atop turret knob 44, and in contact with sensor 154 and scope barrel 41. It should be understood that squaring plate 181 can be used with any of the above sensors and kits.

Using various aspects of the above disclosure, kits can be constructed and methods can be performed for aligning a scope on a gun to a high degree of precision. The alignment does not require that the gun itself be perfectly aligned to vertical and horizontal directions during the process. By using secure sensors that are moved separately, relative alignments are not disturbed. By tying two sensors together electronically so that a relative difference in alignment is calculated and indicated, a user has real-time information useful for aligning the scope. By use of a remote user control device, smartphone, tablet, etc., input and output information can be handled without disturbing the sensors, spaced from the user control device. Thus, a quicker and more accurate scope alignment can be made.

While preferred embodiments of the invention have been described above, it is to be understood that any and all equivalent realizations of the present invention are included within the scope and spirit thereof. Thus, the embodiments depicted are presented by way of example only and are not intended as limitations upon the present invention. Thus, while particular embodiments of the invention have been described and shown, it will be understood by those of ordinary skill in this art that the present invention is not limited thereto since many modifications can be made. Therefore, it is contemplated that any and all such embodiments are included in the present invention as may fall within the literal or equivalent scope of the appended claims

We claim:

1. A kit for aligning a scope on a shooting weapon having a barrel and a forearm, the kit comprising:

a first electronic alignment sensor including a digital protractor;

a second electronic alignment sensor including a digital protractor;

a user control device having an input/output interface in communication with the first and second electronic alignment sensors;

at least one display; and a base member having a support surface and a mounting surface, the mounting surface including a cavity sized for receipt of the barrel portion of the shooting weapon and end portions of two arms sized for placement on opposite sides of the forearm, the mounting surface being configured for overlying the shooting weapon at an index point adjacent the scope;

the first and second electronic alignment sensors being calibratable so that when the first electronic alignment sensor is located on the support surface of the base member at the index point and the second electronic alignment sensor is located on the scope, the display indicates whether relative vertical alignment exists between the first alignment sensor and the second electronic alignment sensor.

2. The kit of claim 1, wherein the display indicates whether relative vertical alignment exists between the first and second electronic alignment sensors via indicia indicating at least one of an amount of and a direction of relative vertical misalignment.

3. The kit of claim 1, wherein the display includes indicia on the first electronic alignment sensor to indicate an orientation relative to vertical.

4. The kit of claim 1, wherein the display includes indicia on the second electronic alignment sensor to indicate an orientation relative to the first electronic alignment sensor.

5. The kit of claim 1, wherein the base member includes a second mounting surface formed along the end portions of the two arms, and the base member further includes a second support surface including a second cavity sized for receipt of a barrel portion of the shooting weapon extending inwardly from the support surface, the cavity and the second cavity having different widths for receipt of differently-sized barrels of shooting weapons.

6. The kit of claim 1, wherein the base member includes at least one magnet for at least one of holding the base member on the shooting weapon and holding at least one of the first and second electronic alignment sensors on the base member.

7. The kit of claim 1, further including a squaring plate having cavity sized for receipt of a turret knob on the scope, the squaring plate having a rear surface for contacting a side of the scope barrel and a side of the second electronic alignment sensor when the turret knob is located in the cavity to align the second electronic alignment sensor with a central axis of the scope.

8. A kit for aligning a scope on a shooting weapon having a barrel and a forearm, the kit comprising:

a first electronic alignment sensor;

a second electronic alignment sensor;

a user control device having an input/output interface in communication with the first and second electronic alignment sensors; and at least one display;

wherein each of the first and the second electronic alignment sensors includes a cavity sized for receipt of the barrel portion and end portions of two arms sized for placement on opposite sides of the forearm, the cavity and two arms being configured for overlying the shooting weapon at an index point adjacent the scope, the first and second electronic alignment sensors being calibratable so that when the first electronic alignment sensor is located at the index point and the second electronic alignment sensor is located on the scope, the display indicates whether relative vertical alignment exists between the first alignment sensor and the second electronic alignment sensor.

9. The kit of claim 8, further including a plate sized for placement between the scope and the second electronic alignment sensor to cover the cavity in the second electronic alignment sensor.

10. The kit of claim 8, wherein the first and second electronic alignment sensors are both digital protractors.

11. The kit of claim 8, wherein the display indicates whether relative vertical alignment exists between the first and second electronic alignment sensors via indicia indicating at least one of an amount of and a direction of relative vertical misalignment.

12. The kit of claim 8, wherein the display includes indicia on the first electronic alignment sensor to indicate an orientation relative to vertical.

13. The kit of claim 8, wherein the display includes indicia on the second electronic alignment sensor to indicate an orientation relative to the first electronic alignment sensor.

14. The kit of claim 8, further including a squaring plate having cavity sized for receipt of a turret knob on the scope, the squaring plate having a rear surface for contacting a side of the scope barrel and a side of the second electronic alignment sensor when the turret knob is located in the cavity to align the second electronic alignment sensor with a central axis of the scope.

15. A kit for aligning a scope having a turret knob on a shooting weapon, the kit comprising:

a first electronic alignment sensor;

a second electronic alignment sensor;

a user control device having an input/output interface in communication with the first and second electronic alignment sensors;

at least one display; and a squaring plate having cavity sized for receipt of the turret knob on the scope, the squaring plate having a rear surface for contacting a side of the scope barrel and a side of the second electronic alignment sensor when the turret knob is located in the cavity to align the second electronic alignment sensor with a central axis of the scope, the first and second electronic alignment sensors being calibratable so that when the first electronic alignment sensor is located at an index point adjacent the scope and the second electronic alignment sensor is located on the scope, the display indicates whether relative vertical alignment exists between the first alignment sensor and the second electronic alignment sensor.

16. The kit of claim 15, wherein the first and second electronic alignment sensors are both digital protractors.

17. The kit of claim 15, wherein the display indicates whether relative vertical alignment exists between the first and second electronic alignment sensors via indicia indicating at least one of an amount of and a direction of relative vertical misalignment.

18. The kit of claim 15, wherein the display includes indicia on the first electronic alignment sensor to indicate an orientation relative to vertical.

19. The kit of claim 15, wherein the display includes indicia on the second electronic alignment sensor to indicate an orientation relative to the first electronic alignment sensor.

20. A kit for aligning a scope on a shooting weapon having a barrel and a forearm and usable with a personal communication device, the kit comprising:

a first electronic alignment sensor;

a second electronic alignment sensor;

a computer program downloadable to and executable on the personal communication device, the first and second electronic alignment sensors being communicatable with the personal communication device and the computer program;

at least one display; and a base member having a support surface and a mounting surface, the mounting surface including a cavity sized for receipt of the barrel portion of the shooting weapon and end portions of two arms sized for placement on opposite sides of the forearm, the mounting surface being configured for overlying the shooting weapon at an index point adjacent the scope;

the first and second electronic alignment sensors being calibratable so that when the first electronic alignment sensor is located on the support surface of the base member at the index point and the second electronic alignment sensor is located on the scope, the display indicates whether relative vertical alignment exists between the first alignment sensor and the second electronic alignment sensor.

21. The kit of claim 20, wherein the first and second electronic alignment sensors are in communication with the personal communication device by at least one of a wired connection and a wireless connection.

22. The kit of claim 21, wherein the personal communication device is one of a user's smartphone, tablet, or computer.

23. The kit of claim 20, wherein the display indicates whether relative vertical alignment exists between the first and second electronic alignment sensors via indicia indicating at least one of an amount of and a direction of relative vertical misalignment.

24. The kit of claim 20, wherein the display includes indicia on the first electronic alignment sensor to indicate an orientation relative to vertical.

25. The kit of claim 20, wherein the display includes indicia on the second electronic alignment sensor to indicate an orientation relative to the first electronic alignment sensor.

26. The kit of claim 20, wherein the display includes indicia on the personal communication device.

27. A kit for aligning a scope on a shooting weapon having a barrel and a forearm, the kit comprising:

a first electronic alignment sensor;

a second electronic alignment sensor;

a user control device having an input/output interface in communication with the first and second electronic alignment sensors;

at least one display; and a base member having a support surface and a mounting surface, the mounting surface including a cavity sized for receipt of the barrel portion of the shooting weapon and end portions of two arms sized for placement on opposite sides of the forearm, the mounting surface being configured for overlying the shooting weapon at an index point adjacent the scope;

the first and second electronic alignment sensors being calibratable so that when the first electronic alignment sensor is located on the support surface of the base member at the index point and the second electronic alignment sensor is located on the scope, the display indicates whether relative vertical alignment exists between the first alignment sensor and the second electronic alignment sensor, wherein the display further includes indicia on the first electronic alignment sensor to indicate an orientation relative to vertical.

28. A kit for aligning a scope on a shooting weapon having a barrel and a forearm, the kit comprising:

a first electronic alignment sensor;

a second electronic alignment sensor;

a user control device having an input/output interface in communication with the first and second electronic alignment sensors;

at least one display; and a base member having a support surface and a mounting surface, the mounting surface including a cavity sized for receipt of the barrel portion of the shooting weapon and end portions of two arms sized for placement on opposite sides of the forearm, the mounting surface being configured for overlying the shooting weapon at an index point adjacent the scope;

the first and second electronic alignment sensors being calibratable so that when the first electronic alignment sensor is located on the support surface of the base member at the index point and the second electronic alignment sensor is located on the scope, the display indicates whether relative vertical alignment exists between the first alignment sensor and the second electronic alignment sensor, wherein the display further includes indicia on the second electronic alignment sensor to indicate an orientation relative to the first electronic alignment sensor.

* * * * *